US008141650B2

(12) United States Patent
Breiner et al.

(10) Patent No.: US 8,141,650 B2
(45) Date of Patent: Mar. 27, 2012

(54) AUTOMATIC DEPTH CORRECTION BASED ON BLADE PITCH

(75) Inventors: Scott Joseph Breiner, Dubuque, IA (US); Brent Allen Smith, Peosta, IA (US); Craig R. Timmerman, Dickeyville, WI (US); Jason P. Mowry, Dubuque, IA (US)

(73) Assignee: Deere & Company, Moline, IL (US)

( * ) Notice: Subject to any disclaimer, the term of this patent is extended or adjusted under 35 U.S.C. 154(b) by 158 days.

(21) Appl. No.: 12/145,253

(22) Filed: Jun. 24, 2008

(65) Prior Publication Data

US 2009/0313860 A1 Dec. 24, 2009

(51) Int. Cl.
*E02F 3/76* (2006.01)

(52) U.S. Cl. ..... 172/4.5; 37/348

(58) Field of Classification Search ..... 172/2–12, 172/779–788, 799, 799.5, 811, 816, 824, 172/828, 830, 934; 37/301, 348; 701/50
See application file for complete search history.

(56) References Cited

U.S. PATENT DOCUMENTS

| | | | | |
|---|---|---|---|---|
| 3,858,663 | A * | 1/1975 | Lurwig, Jr. | 172/445.2 |
| 4,431,060 | A * | 2/1984 | Scholl et al. | 172/4.5 |
| 5,078,215 | A * | 1/1992 | Nau | 172/4.5 |
| 5,560,431 | A * | 10/1996 | Stratton | 172/2 |
| 5,860,480 | A | 1/1999 | Jayaraman et al. | |
| 5,862,868 | A | 1/1999 | Yamamoto et al. | |
| 5,875,854 | A | 3/1999 | Yamamoto et al. | |
| 5,951,613 | A * | 9/1999 | Sahm et al. | 701/50 |
| 6,269,885 | B1 * | 8/2001 | Barber et al. | 172/7 |
| 6,286,606 | B1 * | 9/2001 | Krieg et al. | 172/4.5 |
| 7,121,355 | B2 * | 10/2006 | Lumpkins et al. | 172/4.5 |
| 7,458,428 | B2 * | 12/2008 | Laudick et al. | 172/1 |

* cited by examiner

*Primary Examiner* — Robert Pezzuto
(74) *Attorney, Agent, or Firm* — Faegre Baker Daniels

(57) ABSTRACT

A vehicle includes a blade, a lifting mechanism configured to raise and lower the blade, and a pitching mechanism configured to pitch the blade forward and backward. A control system of the vehicle is configured to automatically maintain at least one of a depth of the blade during pitching of the blade and a pitch of the blade during lifting of the blade.

27 Claims, 5 Drawing Sheets

AUTOMATIC DEPTH CORRECTION BASED ON BLADE PITCH

BACKGROUND

1. Field of the Invention

The present disclosure relates to a vehicle having a blade. More particularly, the present disclosure relates to a device for maintaining a depth of the blade during pitching of the blade, and to a method for utilizing the same.

2. Description of the Related Art

Work vehicles, such as motor graders, bulldozers and crawlers, may be provided with a blade for pushing, shearing, carrying, and leveling soil and other material. The blade is configured to move in various directions relative to a chassis of the vehicle. For example, the blade may be raised and lowered, translated side to side, and rotated side to side, relative to the chassis.

The blade may also be pitched forward and backward relative to the chassis. The pitch of the blade, or the angle formed between the blade and the ground, may be adjusted to alter the blade's performance when pushing, shearing, carrying, and spreading material. For example, the blade is generally pitched backward when handling hard, compact soil, and the blade is generally pitched forward when handling soft soil.

SUMMARY

The present disclosure relates to a vehicle configured to automatically maintain a depth of the blade during pitching of the blade. The present disclosure also relates to a method for utilizing the same.

According to an embodiment of the present disclosure, a vehicle is disclosed that includes a chassis, at least one ground engaging mechanism configured to support and propel the chassis, and a blade coupled to the chassis. The vehicle further includes a lifting mechanism and a pitching mechanism, and a control system. The lifting mechanism is configured to raise and lower the blade relative to the chassis, and the pitching mechanism is configured to pitch the blade forward and backward relative to the chassis. The control system is configured to operate the lifting mechanism, operate the pitching mechanism, and coordinate pitching and lifting of the blade to maintain at least one of a depth of the blade during pitching and a pitch of the blade during lifting.

According to another embodiment of the present disclosure, a vehicle is disclosed that includes a chassis, a ground engaging mechanism configured to support and propel the chassis, and a blade coupled to the chassis. The blade is configured to be lifted upward and downward and pitched forward and backward relative to the chassis. The vehicle further includes a means for automatically maintaining at least one of a depth of the blade during pitching and a pitch of the blade during lifting.

According to yet another embodiment of the present disclosure, a method is disclosed for adjusting a blade. The method includes the steps of providing a vehicle having a chassis and a blade coupled to the chassis, performing one of pitching and lifting of the blade relative to the chassis, and automatically maintaining at least one of a depth of the blade during pitching of the blade and a pitch of the blade during lifting of the blade.

BRIEF DESCRIPTION OF THE DRAWINGS

The above-mentioned and other features of the present disclosure will become more apparent and the present disclosure itself will be better understood by reference to the following description of embodiments of the present disclosure taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
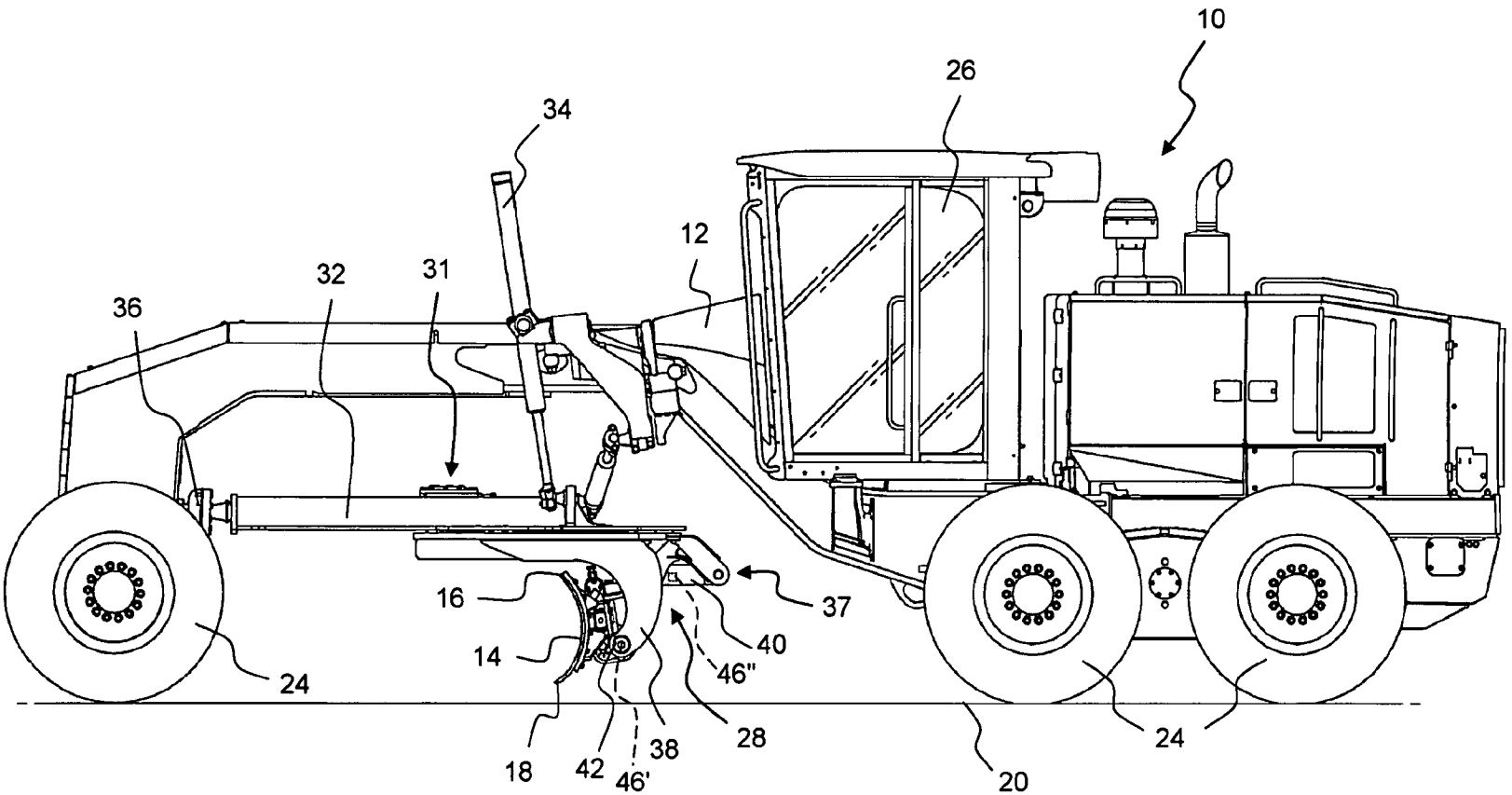
FIG. 1 is a side elevational view of a motor grader having a moldboard assembly of the present disclosure.
Figure 3:
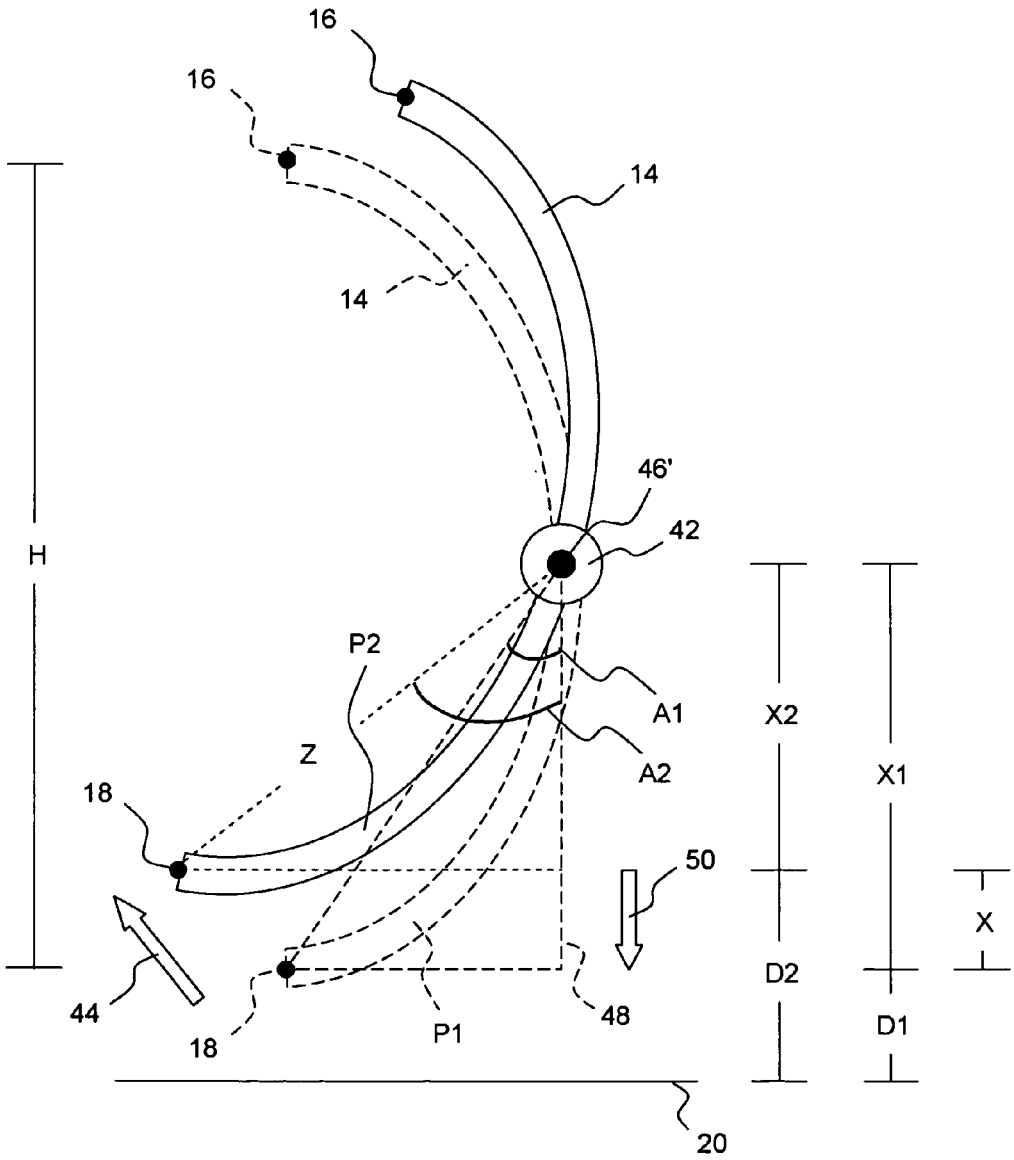
FIG. 3 is a side elevational view of a blade of the motor grader illustrating an embodiment of the present disclosure.

Referring to FIG. 1, a vehicle in the form of motor grader 10 is provided. Motor grader 10 includes chassis 12 and blade 14 coupled to chassis 12. Although the vehicle is illustrated and described herein as motor grader 10, the vehicle may include any other type of vehicle having a blade, such as a bulldozer or a crawler. In operation, blade 14 is configured to push, shear, carry, and spread dirt and other material. Blade 14 includes top edge 16 and cutting edge 18. Cutting edge 18 is located nearest to ground 20 and is configured to engage ground 20 during operation of motor grader 10. The linear distance between top edge 16 and cutting edge 18 is equal to height H of blade 14 (FIG. 3). When viewed from a side of motor grader 10, as in FIG. 1, blade 14 may be concave in shape.

Referring still to FIG. 1, motor grader 10 further includes ground engaging mechanism 24 and operator station 26. Ground engaging mechanism 24 is coupled to chassis 12 and may include any device capable of supporting and/or propelling chassis 12 across ground 20. For example, as illustrated in FIG. 1, ground engaging mechanism 24 includes wheels. When the vehicle is in the form of motor grader 10, blade 14 is positioned between front and back ground engaging mechanisms 24. Operator station 26 is supported by chassis 12 and provides a location for an operator of motor grader 10. Operator station 26 includes components necessary to operate motor grader 10, such as a steering wheel and controls.

Figure 2:
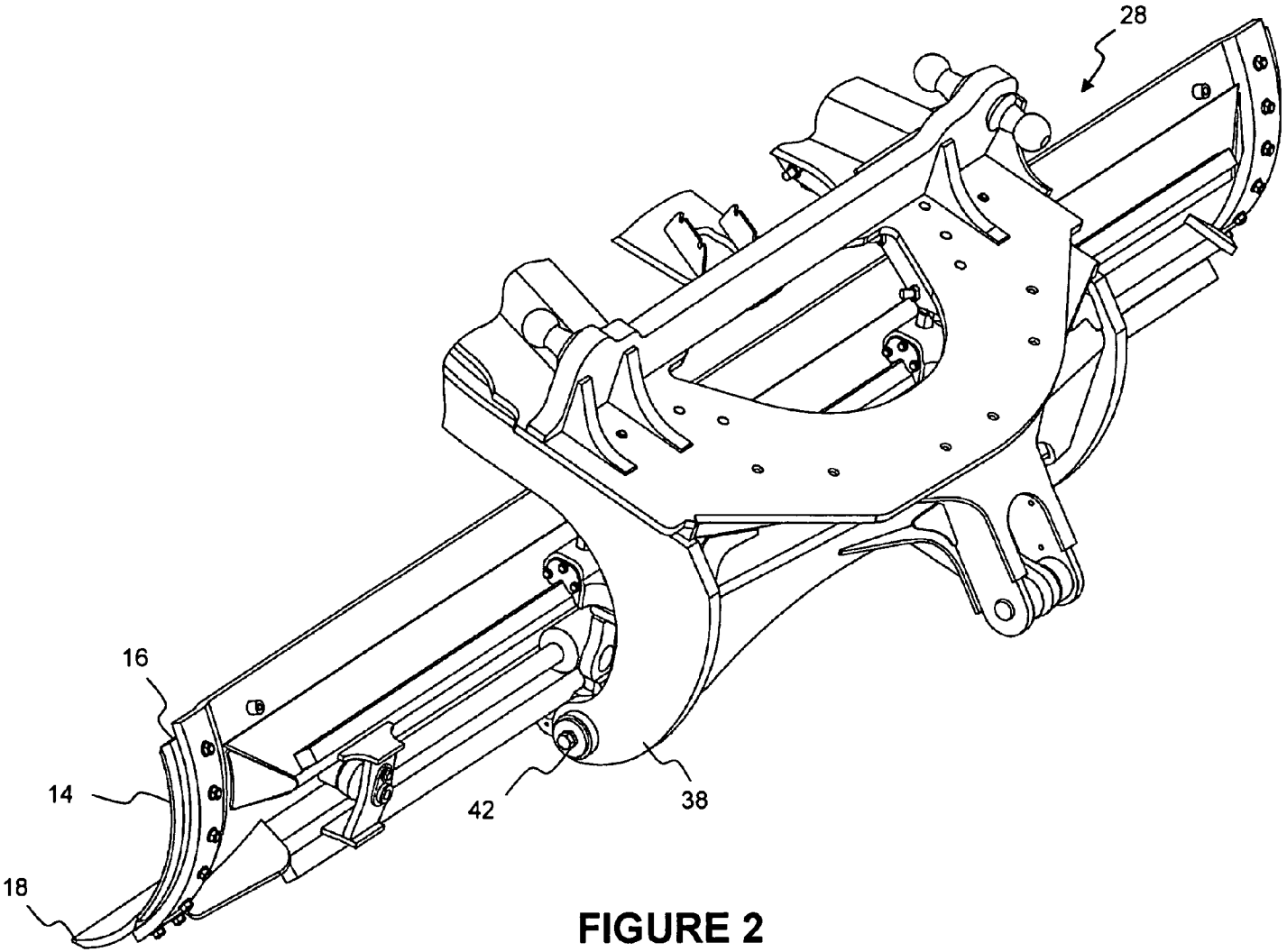
FIG. 2 is a perspective view of the moldboard assembly of FIG. 1.
Figure 4:
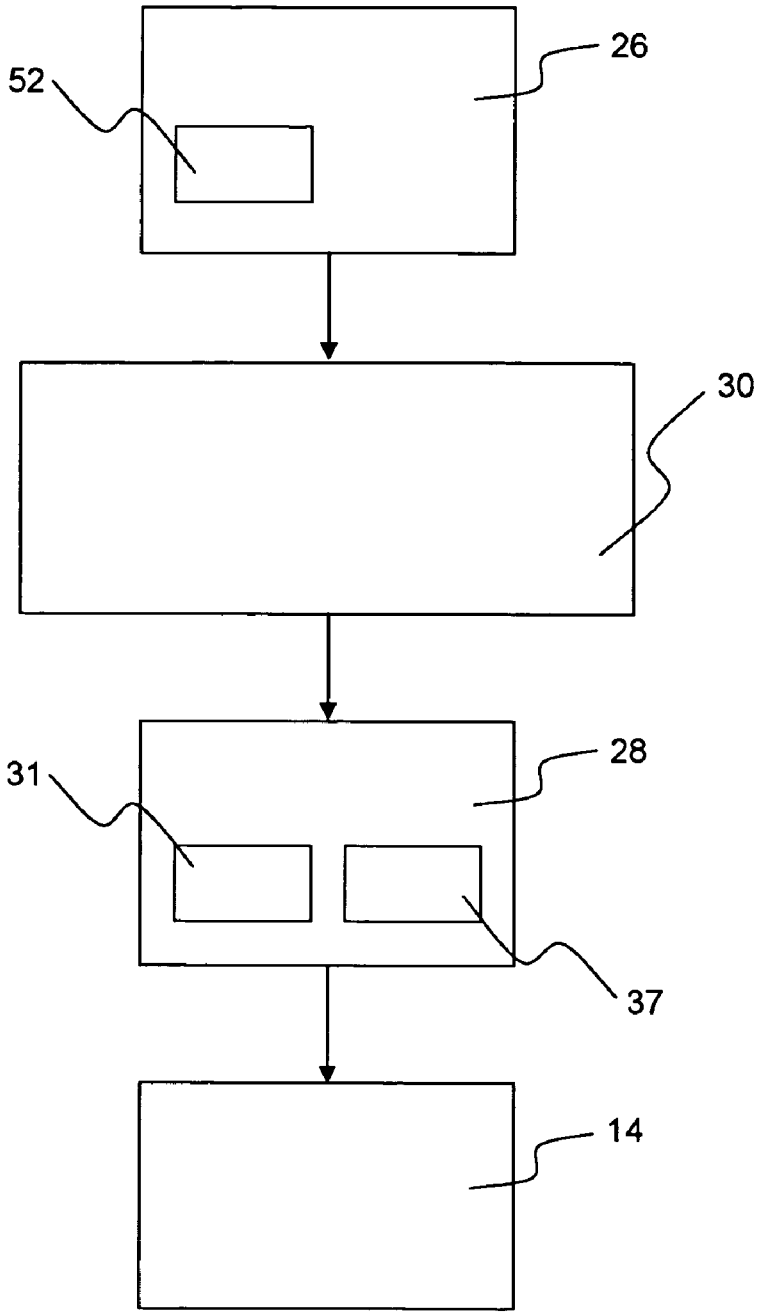
FIG. 4 is a schematic diagram of a control system of the present disclosure.
Figure 5:
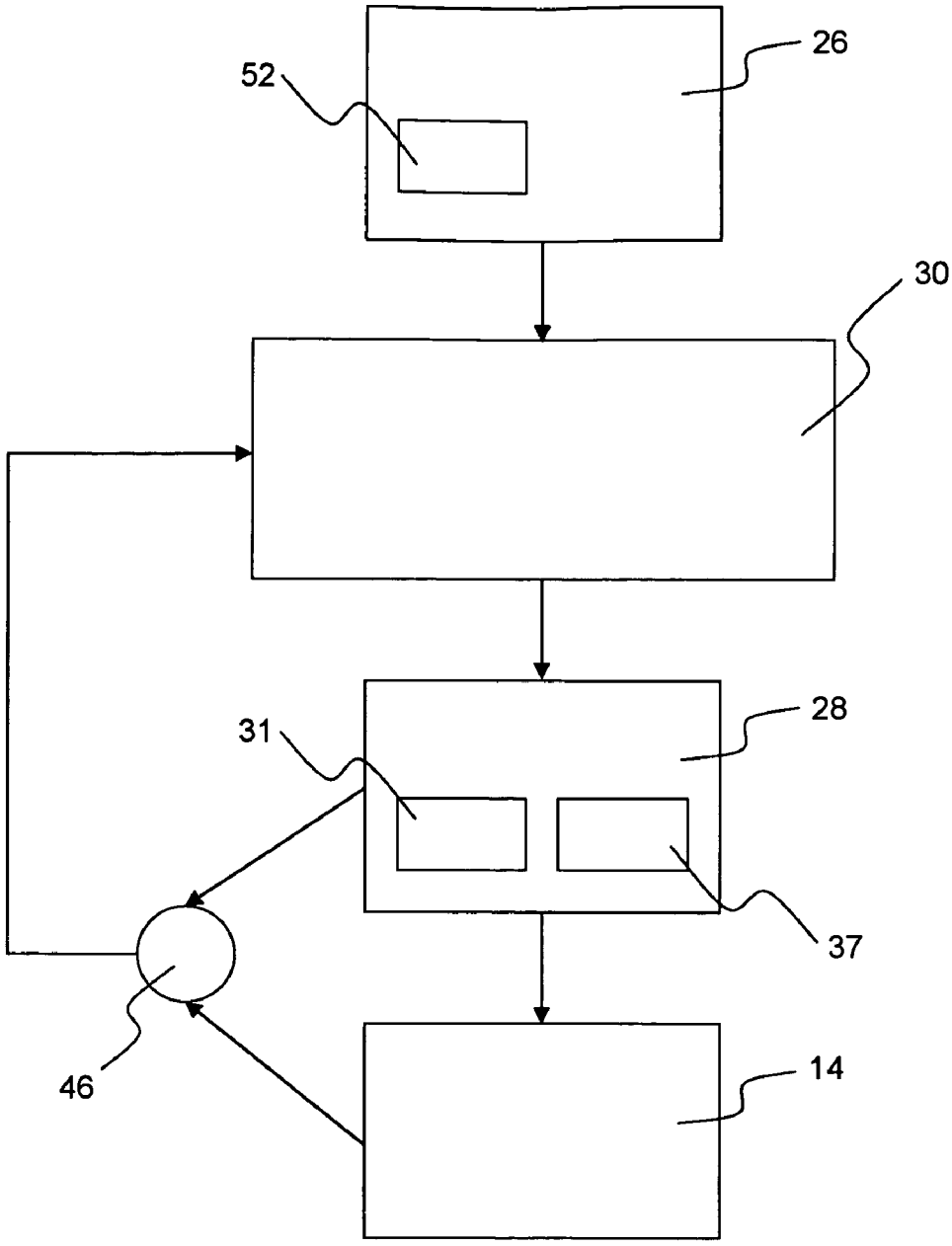
FIG. 5 is a schematic diagram of another control system of the present disclosure.

Referring to FIGS. 1 and 2, motor grader 10 further includes moldboard assembly 28. Moldboard assembly 28 is provided to couple blade 14 to chassis 12 and to move blade 14 relative to chassis 12. For example, moldboard assembly 28 includes various working elements configured to raise and lower blade 14 relative to chassis 12, translate blade 14 side to side relative to chassis 12, rotate blade 14 side to side relative to chassis 12, and pitch blade 14 forward and backward relative to chassis 12. The working elements of moldboard assembly 28 are automatically operated by control system 30 (FIGS. 4 and 5). Control system 30 may include controls within operator station 26 that allow the operator to control the position of blade 14 from within operator station 26.

Referring still to FIGS. 1 and 2, to raise and lower blade 14 relative to chassis 12, moldboard assembly 28 includes lifting mechanism 31. An exemplary lifting mechanism 31 includes draft frame 32 and at least one hydraulic lift cylinder 34. Blade 14 is coupled to draft frame 32, and draft frame 32 is pivotably coupled to chassis 12 at pivot point 36. As hydraulic lift cylinder 34 extends and retracts, draft frame 32 pivots about pivot point 36, and blade 14 coupled to draft frame 32 is raised and lowered relative to chassis 12. As discussed in more detail below, raising and lowering blade 14 may affect the pitch of blade 14.

Referring still to FIGS. 1 and 2, to pitch blade 14 forward and backward relative to chassis 12, moldboard assembly 28 includes pitching mechanism 37. An exemplary pitch mechanism 37 includes circle frame 38 and hydraulic pitch cylinder 40. Circle frame 38 is coupled to draft frame 32, and blade 14 is pivotably coupled to circle frame 38 at pivot point 42. Pivot point 42 may include any known pivot joint. For example, as shown in FIG. 2, a pin coupled to blade 14 is pivotably inserted through an aperture in circle frame 38. Pivot point 42 may be located at various positions along blade 14, including but not limited to the center of blade 14. As hydraulic pitch cylinder 40 extends and retracts, blade 14 pitches forward and backward about pivot point 42 relative to circle frame 38, draft frame 32, and chassis 12. As discussed in more detail in the following paragraph, pitching blade 14 forward and backward may affect the depth of blade 14.

Referring to FIG. 3, blade 14 has been pitched in the direction indicated by arrow 44. More specifically, blade 14 has been pitched backward relative to chassis 12 (FIG. 1) about pivot point 42, from first pitch position P1 (shown in phantom) to second pitch position P2 (shown in solid). As shown in FIG. 3, adjusting the pitch of blade 14 forward and backward may alter the depth of blade 14. As used herein, the depth of blade 14 is equal to the vertical distance between blade 14 and ground 20, and more specifically the vertical distance between cutting edge 18 of blade 14 and ground 20. The depth of blade 14 may impact the performance of blade 14 when pushing, shearing, carrying, and spreading material. In the illustrated embodiment, as blade 14 is pitched backward from first pitch position P1 to second pitch position P2, the depth of blade 14 increases from first depth D1 to second depth D2, which may alter the performance of blade 14. Similarly, as blade 14 is pitched forward, the depth of blade 14 decreases, which may also alter the performance of blade 14.

In one form, the present disclosure provides a means for automatically maintaining the depth of blade 14 during adjustment of the pitch, as illustrated in FIGS. 3-5. The maintenance means is configured to respond to an adjustment of the pitch of blade 14 by adjusting the depth of blade 14. Specifically, the maintenance means is configured to maintain blade 14 at first depth D1.

An embodiment of the maintenance means, illustrated in FIG. 5, includes at least one sensor 46 in communication with control system 30. Sensor 46 is configured to communicate information regarding blade 14 to control system 30, and specifically information regarding the pitch of blade 14. Therefore, sensor 46 may be coupled to the working elements of moldboard assembly 28 or to blade 14 itself. Sensor 46 is configured to communicate with control system 30 regularly after a certain time interval, such as approximately 20 milliseconds.

In an exemplary embodiment of the present disclosure, illustrated in FIGS. 1 and 5, sensor 46 is a linear sensor 46" coupled to hydraulic pitch cylinder 40. In this embodiment, sensor 46" is configured to determine and communicate the position of hydraulic pitch cylinder 40 to control system 30. Based on the extension/retraction of hydraulic pitch cylinder 40, control system 30 may then calculate the angular position of blade 14 about pivot point 42.

In another exemplary embodiment of the present disclosure, illustrated in FIGS. 1, 3, and 5, sensor 46 is a rotary sensor 46', such as a potentiometer, coupled to pivot point 42. In this embodiment, sensor 46' is configured to determine and communicate an actual angular position of blade 14 about pivot point 42 to control system 30. More specifically, as shown in FIG. 3, sensor 46' is configured to determine the actual angular position of cutting edge 18 of blade 14 about pivot point 42 relative to vertical axis 48. Sensor 46' is positioned linear distance Z from cutting edge 18 of blade 14. Distance Z depends on height H of blade 14 and the position of sensor 46' along blade 14. For example, if blade 14 were straight and not concave, distance Z would equal approximately half of height H of blade 14. As blade 14 is pitched backward from first pitch position P1 to second pitch position P2, the angular position of blade 14 relative to vertical axis 48 changes from first angle A1 to second angle A2. Sensor 46' determines first angle A1 and second angle A2, and then sensor 46 communicates the same to control system 30.

Referring to FIG. 5, after receiving periodic information from sensor 46, control system 30 calculates depth adjustment X, the difference between second depth D2 and first depth D1. As shown in FIG. 3, depth adjustment X is equal to the difference between X1 and X2, where X1 and X2 equal the vertical distances between pivot point 42 and cutting edge 18 of blade 14. Therefore, depth adjustment X may be calculated as follows:

$$X=D2-D1=X1-X2$$

where:

X1=Z*cos(A1)

X2=Z*cos(A2)

After calculating depth adjustment X, control system 30 directs blade 14 to move vertically the calculated distance to return to first depth D1. In the illustrated embodiment, control system 30 directs blade 14 to move vertically in a direction indicated by arrow 50, thereby maintaining blade 14 at first depth D1 by returning blade 14 to first depth D1. Returning blade 14 to first depth D1 restores the original distance between cutting edge 18 of blade 14 and ground 20. An exemplary lifting mechanism 31 for raising and lowering blade 14 relative to chassis 12 of vehicle 10 is described in detail above and illustrated in FIG. 1. To lower blade 14 using lifting mechanism 31, control system 30 (FIG. 4) directs hydraulic fluid to hydraulic lift cylinder 34 of moldboard assembly 28 causing hydraulic lift cylinder 34 to extend, and causing blade 14 to lower relative to chassis 12.

Another embodiment of the maintenance means, illustrated in FIG. 4, includes control system 30 in communication with moldboard assembly 28. Rather than measuring an actual angular position of blade 14 about pivot point 42, control system 30 may measure the anticipated angular position of blade 14 about pivot point 42. Control system 30 may simultaneously coordinate pitching and lifting of blade 14 such that blade 14 remains at first depth D1 without traveling to second depth D2. In the illustrated embodiment, control system 30 simultaneously directs blade 14 to pitch backward from first pitch position P1 to second pitch position P2 and to move vertically in a direction indicated by arrow 50, thereby maintaining blade 14 at first depth D1.

Although the maintenance means has been described in terms of pitching blade 14 backward relative to chassis 12, the same principles may be applied when pitching blade 14 forward relative to chassis 12. In the equation set forth above, D1 would exceed D2, resulting in a negative value for depth adjustment X. Control system 30 would respond to the negative value of depth adjustment X by raising blade 14 rather than lowering blade 14. To raise blade 14 using lifting mechanism 31 of FIG. 1, control system 30 (FIG. 4) directs hydraulic fluid to hydraulic lift cylinder 34 of moldboard assembly 28 causing hydraulic lift cylinder 34 to retract, and causing blade 14 to rise relative to chassis 12.

It is within the scope of the present disclosure to apply the same principles when raising and lowering blade 14 relative to chassis 12 to maintain the pitch of blade 14. As mentioned above, operating lifting mechanism 31 to raise and lower blade 14 about pivot point 36 may affect the pitch of blade 14 (FIG. 1). Therefore, the maintenance means may also be configured to respond to lifting of blade 14 by adjusting the pitch of blade 14. In the equation set forth above, first depth D1 and second depth D2 may be measured by a sensor, such as a sensor mounted at pivot point 36 or hydraulic lift cylinder 34. After receiving information from the sensor, control system 30 calculates an angular adjustment and operates pitching mechanism 37 to maintain blade 14 at a desired pitch, such as by returning blade 14 to the desired pitch. The incidental depth change when pitching blade 14 may be more significant than the incidental pitch change of blade 14 when raising and lowering blade 14 due to the shorter distance between pivot point 42 and blade 14 than between pivot point 36 and blade 14.

The maintenance means may be consistently activated during operation of motor grader 10. On the other hand, the operator may choose to deactivate the maintenance means. For example, the operator may deactivate the maintenance means from monitor 52, such as a touch screen monitor, in operator station 26 (FIGS. 4 and 5).

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vehicle including:

a chassis;

at least one ground engaging mechanism configured to support and propel the chassis;

a blade coupled to the chassis;

a lifting mechanism configured to raise and lower the blade relative to the chassis;

a pitching mechanism configured to pitch the blade forward and backward relative to the chassis; and a control system programmed to operate the lifting mechanism, operate the pitching mechanism, and coordinate pitching and lifting of the blade to maintain at least one of a depth of the blade during pitching and a pitch of the blade during lifting.

2. The vehicle of claim 1, wherein the control system is programmed to automatically respond to an adjustment of the pitch by operating the lifting mechanism.

3. The vehicle of claim 1, wherein the at least one ground engaging mechanism includes a front ground engaging mechanism and a back ground engaging mechanism, and the vehicle is a motor grader with the blade positioned between the front ground engaging mechanism and the back ground engaging mechanism.

4. The vehicle of claim 1, further including a sensor coupled to the blade and configured to communicate information regarding the pitch of the blade to the control system.

5. The vehicle of claim 1, wherein:

the blade is configured to pitch about a pivot point; and the vehicle further includes a rotary sensor coupled to the pivot point and configured to communicate an angle of the blade to the control system.

6. The vehicle of claim 1, wherein:

the pitching mechanism includes a hydraulic cylinder; and the vehicle further includes a linear sensor coupled to the hydraulic cylinder and configured to communicate information regarding the pitch of the blade to the control system.

7. The vehicle of claim 1, wherein the blade is configured to pitch about a pivot point, the pivot point being centered on the blade.

8. The vehicle of claim 1, wherein the control system is programmed to calculate the depth of the blade based at least in part on the pitch of the blade.

9. The vehicle of claim 1, wherein:

the pitching mechanism is configured to pitch the blade relative to the chassis from a first pitch position to a second pitch position, the blade being positioned at a first depth in the first pitch position and a second depth in the second pitch position; and the control system is programmed to calculate a difference between the first depth and the second depth.

10. The vehicle of claim 9, wherein the control system is programmed to operate the lifting mechanism to position the blade at the first depth.

11. A vehicle including:

a chassis;

a ground engaging mechanism configured to support and propel the chassis;

a blade coupled to the chassis, the blade configured to be lifted upward and downward and pitched forward and backward relative to the chassis; and a means for automatically maintaining at least one of a depth of the blade during pitching of the blade relative to the chassis and a pitch of the blade during lifting of the blade relative to the chassis.

12. The vehicle of claim 11, wherein the vehicle is a motor grader with the blade positioned between a front ground engaging mechanism and a back ground engaging mechanism.

13. The vehicle of claim 11, further including a sensor coupled to the blade, the sensor being configured to measure the pitch of the blade.

14. The vehicle of claim 11, wherein:

the blade is configured to pitch about a pivot point; and the vehicle further includes a rotary sensor coupled to the pivot point, the rotary sensor being configured to measure the pitch of the blade about the pivot point.

15. The vehicle of claim 11, further including:

a hydraulic cylinder configured to pitch the blade forward and backward relative to the chassis; and a linear sensor coupled to the hydraulic cylinder and configured to communicate information regarding the pitch of the blade to the control system.

16. The vehicle of claim 11, wherein the blade is configured to pitch about a pivot point, the pivot point being centered on the blade.

17. The vehicle of claim 11, wherein the maintenance means is programmed to respond to an adjustment of the pitch by adjusting the depth of the blade.

18. The vehicle of claim 11, wherein the maintenance means is programmed to calculate the depth of the blade based at least in part on the pitch of the blade.

19. The vehicle of claim 11, wherein:

the blade is configured to pitch relative to the chassis from a first pitch position to a second pitch position, the blade being positioned at a first depth in the first pitch position and a second depth in the second pitch position; and the maintenance means is programmed to calculate a difference between the first depth and the second depth.

20. The vehicle of claim 19, wherein the maintenance means is programmed to raise and lower the blade to the first depth.

21. A method of adjusting a blade including the steps of:

providing a vehicle having a chassis and a blade coupled to the chassis;

performing one of pitching and lifting of the blade relative to the chassis; and automatically maintaining at least one of a depth of the blade during pitching of the blade relative to the chassis and a pitch of the blade during lifting of the blade relative to the chassis.

22. The method of claim 21, wherein:

pitching the blade includes pitching the blade from a first pitch position to a second pitch position, the blade being positioned at a first depth in the first pitch position and a second depth in the second pitch position; and automatically maintaining the depth of the blade includes returning the blade to the first depth.

23. The method of claim 22, further including the step of automatically calculating the first depth and the second depth based at least in part on the pitch of the blade.

24. The method of claim 23, wherein the step of calculating the first depth and the second depth is based at least in part on a height of the blade.

25. The method of claim 22, further including the steps of:

automatically calculating a difference between the first depth and the second depth; and automatically moving the blade vertically a distance equal to the difference between the first depth and the second depth.

26. The method of claim 21, wherein:

pitching the blade includes pitching the blade one of backward and forward relative to the chassis; and automatically maintaining the depth of the blade includes one of lowering and raising the blade relative to the chassis.

27. The method of claim 21, wherein automatically maintaining the depth of the blade includes simultaneously pitching and lifting the blade relative to the chassis.

* * * * *